US007458121B1

(12) United States Patent
Hsu

(10) Patent No.: US 7,458,121 B1
(45) Date of Patent: Dec. 2, 2008

(54) HEALTH BED CAPABLE OF ADJUSTING THE SPINE CURVE OF A HUMAN BODY

(76) Inventor: Han-Chung Hsu, 5F, No. 205, Wusing St., Sinyi District, Taipei (TW)

( * ) Notice: Subject to any disclaimer, the term of this patent is extended or adjusted under 35 U.S.C. 154(b) by 0 days.

(21) Appl. No.: 11/745,496

(22) Filed: May 8, 2007

(51) Int. Cl.
*A47C 23/04* (2006.01)
*A47C 17/00* (2006.01)

(52) U.S. Cl. ..... 5/716; 5/697; 5/727; 5/935; 5/936

(58) Field of Classification Search ..... 5/690, 5/716, 727, 600, 613; 187/267, 268
See application file for complete search history.

(56) References Cited

U.S. PATENT DOCUMENTS

| | | | | |
|---|---|---|---|---|
| 4,222,137 | A * | 9/1980 | Usami | 5/727 |
| 5,148,706 | A * | 9/1992 | Masuda et al. | 73/172 |
| 7,093,312 | B2 * | 8/2006 | Mossbeck | 5/613 |
| 2007/0163043 | A1 * | 7/2007 | Lemire et al. | 5/600 |

* cited by examiner

*Primary Examiner*—Patricia Engle
*Assistant Examiner*—Jonathan J Liu
(74) *Attorney, Agent, or Firm*—Ming Chow; Sinorica, LLC

(57) ABSTRACT

A health bed capable of adjusting the spine curve of a human body mainly comprises a plurality of elevators. Each of the elevators includes a lower plate having several upholders extending therefrom wherein a motor is fixed on the center of the lower plate and the axle of the motor is a screw engaged with the middle of a motor-driven base such that the motor-driven base can be moved upward or downward by a drive of the screw. The upholders support the motor-driven base is disposed above the lower plate and supported by upholders. A plurality of elastic objects is disposed on the motor-driven base in which the elastic object has a sense stick inside and the sense stick penetrates out of the bottom of the motor-driven base. A height sensor lateral the base may thus measure a downside movement of the elastic objects. The height sensor and the motor are connected to a control circuit that actuates the motors to drive the motor-driven bases upwardly to a desired height by receiving signals from the height sensors. When a user lies on the bed, each of the elevators actively sustains the spine curve of human body, achieving a comfortable sleep.

2 Claims, 4 Drawing Sheets

HEALTH BED CAPABLE OF ADJUSTING THE SPINE CURVE OF A HUMAN BODY

BACKGROUND OF THE INVENTION

1. Field of the Invention

The present invention relates to a health bed capable of adjusting spin curve of a human body; particularly, relates to a health bed capable of adjusting spin curve that, acquiring a lying-down curve of the body of a user first as purchasing a bed, the health bed may determines whether the one who lies on the health bed is the user, and spontaneously proceeds to support the body curve so as to provide the user a best comfortable sleep.

2. Description of the Prior Art

Upon development of science and technology industry, modern people have suffered from sleeplessness for a long time due to stress, which causes anxiety-depression, melancholia, shoulder and neck pain, waist and back pain, headache, tiredness, palpitations, alopecia, etc. Therefore, in order to provide a comfortable sleeping quality for people, normally, manufacturers make an improvement to mattress. The types of conventional mattresses are various, such as memory bed, health bed, energy bed, and so on. However, the common feature of those conventional mattresses is to provide a passive support through the springs inside a bed to support the user's body. Actually, the springs are forced downwardly instead of a real support to solve the user's suffering of sleeplessness.

In view of the above, the conventional stuff still has a lot of drawbacks to be fine-designed goods and should be improved.

Upon the drawbacks incurred from the above conventional goods, the inventor of the present invention has given every effort in reformation and innovation. After years of painstaking efforts, finally, a health bed capable of adjusting spin curve of a human body has been successfully developed.

SUMMARY OF THE INVENTION

The objective of the present invention is to provide a health bed capable of adjusting the spine curve of a human body that when a user purchases the bed, his/her body curve will be measured, and the measured curve will be memorized in a control circuit of the health bed. When someone lies on the bed, the health bed determines whether the one who lies on the bed is the original user, and if the one is the user, the health bed will be adjusted through elevators inside the bed according to the curve memorized beforehand to initially provide a support for the human body. As a result, the user may thus have a comfortable sleep.

Another objective of the present invention is to provide a health bed capable of adjusting the spine curve of a human body that has advantages such as easy to operate, easy to assemble, and high practicability.

A health bed capable of adjusting the spine curve of a human body, achieving the above objectives, comprises a plurality of elevators each enclosed by a mattress and bed cover; the elevator includes a lower plate having several upholders extending therefrom wherein a motor is coupled at the center of the lower plate and the axle of the motor is a screw linked with the middle of a motor-driven base such that the motor-driven base can be moved upward or downward by the drive of the screw. The upholders support the motor-driven base on the lower plate so as to increase a stability of the motor-driven base. A plurality of elastic objects is disposed on the motor-driven base in which the elastic object has a sense stick inside and the sense stick penetrates out of the bottom of the motor-driven base. A height sensor lateral the base may thus measure a downside distance of the elastic objects, and the height sensor and the motor are connected to a control circuit. When a user wants to purchase the health bed, firstly, the body curve of the user will be memorized and stored by the control circuit. The control circuit determines whether the one is the user if someone lies on the bed, and the motor will drive the motor-driven base to lift to a desired height, adjusting the mattress of the health bed to be a most natural spine curve of human body, and rendering the user being most relaxed to get a preferable sleep.

These features and advantages of the present invention will be fully understood and appreciated from the following detailed description of the accompanying Drawings.

DETAILED DESCRIPTION OF THE PREFERRED EMBODIMENT

Figure 1:
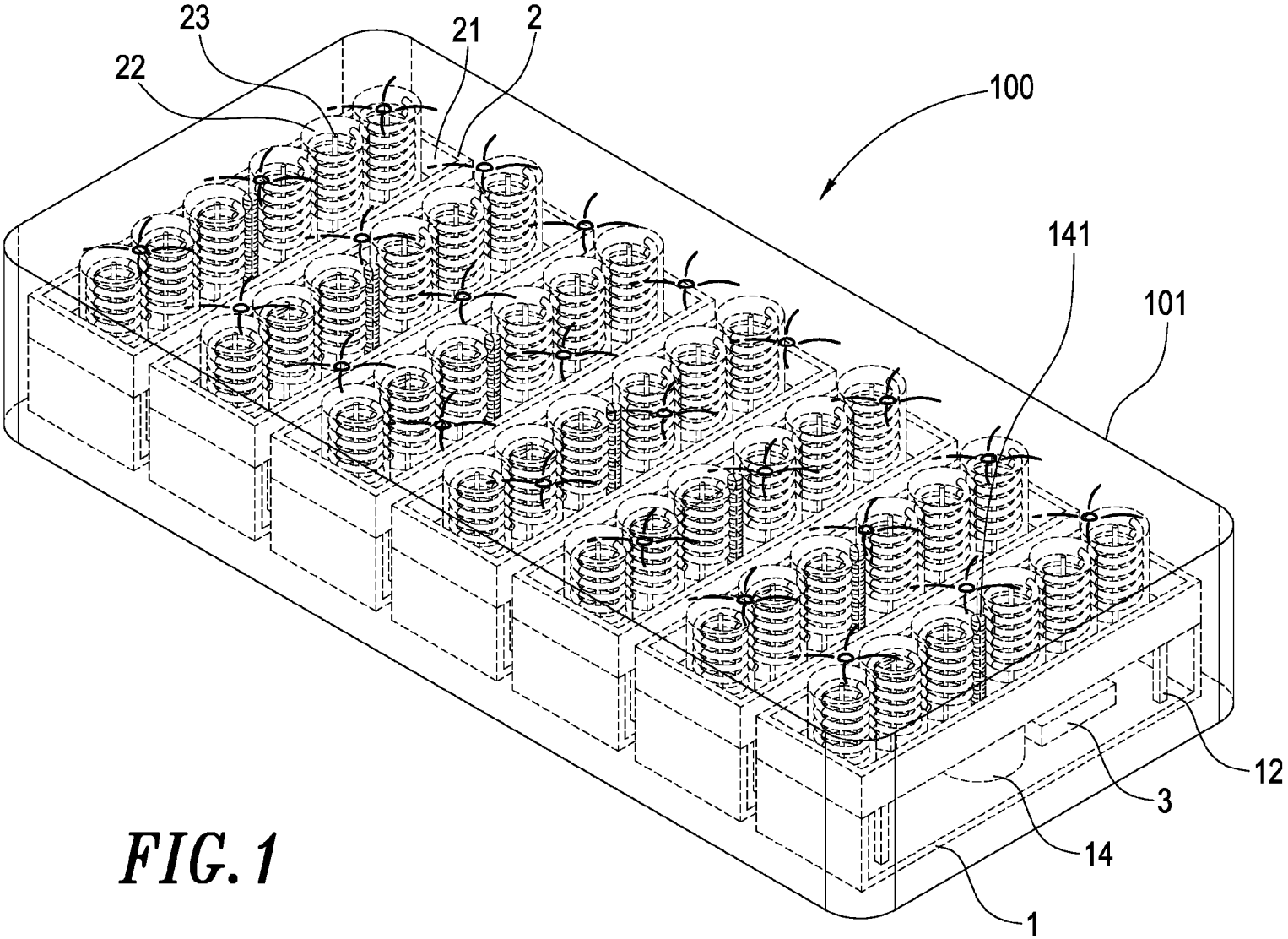
FIG. 1 is a schematic diagram of a health bed capable of adjusting spin curve of a human body of the present invention.
Figure 2:
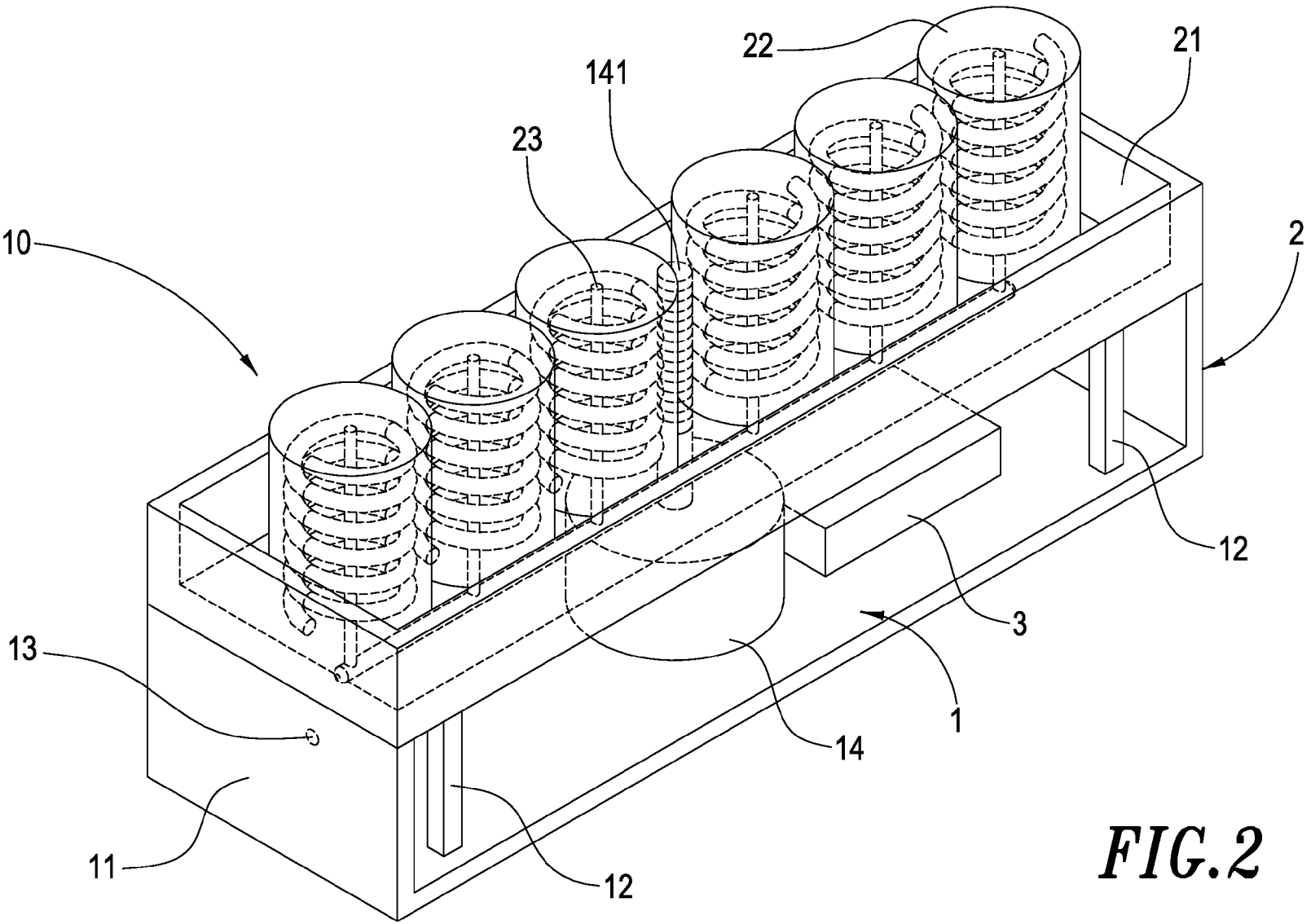
FIG. 2 is a schematic diagram of the elevator of a health bed capable of adjusting spin curve of a human body of the present invention.

FIGS. 1 and 2 illustrate a health bed capable of adjusting spin curve of a human body of the present invention that primarily comprises a plurality of elevators 10 arranged in the same space and enclosed by the mattress and bed cover 101 to form the health bed 100. The elevator 10 includes:

A lower plate 1 wherein the side plate 11 upwardly extends from two ends of the lower plate 1 and a plurality of upholders 12 is disposed on the top of the lower plate 1. The height of the upholders 12 is identical to the side plate 11 and the height sensor 13 is disposed on the side plate 11. The motor 14 is fixed at the center of the lower plate 1, and the axle 141 of the motor 14 is a screw;

A motor-driven base 2 has a positioning trench 21 thereon. A plurality of holes is set on the positioning trench 21 with same interspaces (not shown) and a screw hole (not shown) is set on the middle of the positioning trench. A plurality of elastic objects 22 is disposed with same interspaces on the positioning trench 21, corresponding to the holes on the positioning trench 21. The sense stick 23 inside the elastic object 22 may thus penetrate the bottom of the motor-driven base 2 through the holes on the positioning trench 21. The screw hole of the motor-driven base 2 is engaged with the axle 141 of the motor 14 to let the motor-driven base 2 above the top of the plate 1 and being supported by the side plates 11 and the upholders 12. In addition, the motor-driven base can be driven by the axle 141 of the motor 14 to have a upward or downward movement;

A control circuit 3 that connects to the height sensor 13 of each elevators 10 and motor 14. When receiving height signals from the height sensor 13, the control circuit 3 actuates the motor 14 of each elevator 10 to operate in accordance with the received signals, rendering that the axle 14 of the motor 14 may drives the motor-driven base 2 to move upward or downward.

Figure 3A:
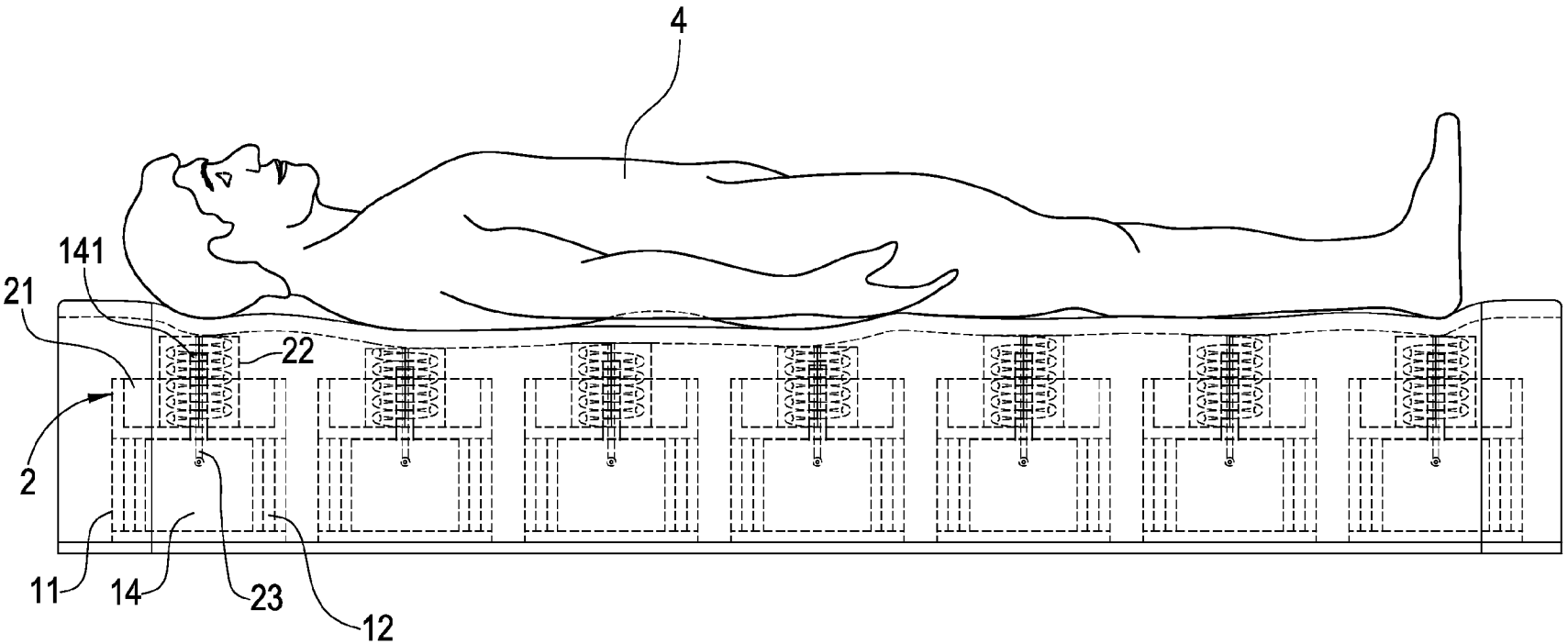
FIGS. 3A and 3B are implementing diagrams of a health bed capable of adjusting spin curve of a human body of the present invention.
Figure 3B:
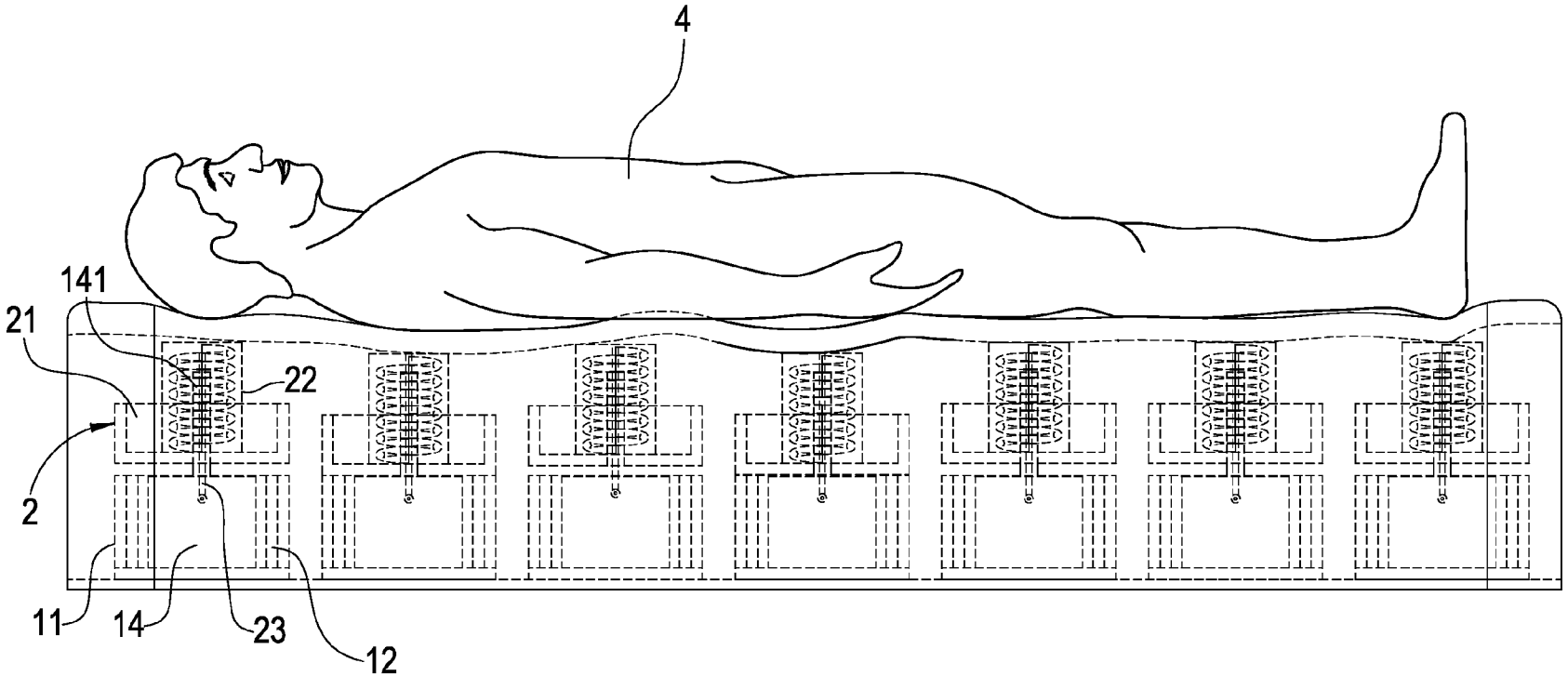

FIGS. 3A and 3B illustrate implementing diagrams of the present invention. When the user 4 intends to purchase the health bed 100, the seller firstly asks the user 4 to lie down on the bed. The elastic objects 22 on the motor-driven base 2 of each elevator 10 will descend a different distance, respectively, based on different pressure the elastic object has carried. Consequently, the sense stick 23 inside the elastic object 22 moves downward so that the height sensor 13 on the lower plate 1 may measures a movement of the elastic object and then transmits the measurement to the control circuit 3 so as to acquire the spine curve of the user 4 as lying down.

When someone lies on the bed, the control circuit 3 will determine whether the one who lies on the bed is the user based on a difference of the height of the elastic object 2 of each elevator 10. If the one is the user, each motor-driven base 2 will be driven by respective motor 14 of elevator 10 to lift to a desired height, adjusting the mattress of the health bed 100 as a most natural spine curve of human body to provide an active support for the spine of the user. As a result, the user may be relaxed lying on the bed to get a preferable sleep quality.

In comparison with other conventional techniques, the health bed capable of adjusting spin curve of a human body of the present invention further provides advantages as follows:

1. The present invention provides a health bed capable of adjusting the spine curve of a human body that when a user purchases the bed, his/her body curve will be measured, and the measured curve will be memorized in a control circuit of the health bed. When someone lies on the bed, the health bed determines whether the one who lies on the bed is the original user, and if the one is the user, the health bed will be adjusted through elevators inside the bed according to the curve memorized beforehand to actively provide a support for the human body. As a result, the user may thus have a comfortable sleep.

2. The present invention provides advantages such as easy to operate, easy to assemble, and high practicability.

The above detailed description is a concrete explanation for a practicable embodiment of the present invention rather than a limitation to the claim scope of the application. Any equivalent practice or modification contained in the concept of the present invention should be included in the claim scope of the application.

Many changes and modification in the above-described embodiment of the invention can, of course, be carried out without departing from the scope thereof. Accordingly, to promote the progress in science and the useful arts, the invention is disclosed and is intended to be limited only by the scope of the appended claims.

We claim:

1. A health bed capable of adjusting the spine curve of a human body, comprising:

a plurality of elevators enclosed by a mattress and a bed cover to from the health bed;

each of said elevators arranged in an equal distance apart from each other;

wherein each of the plurality of elevators comprises:

a lower plate;

a plurality of side plates;

a plurality of upholders, wherein the plurality of upholders are disposed on top of the lower plate, and the height of the plurality of upholders is the same as the height of the plurality of side plates;

a motor fixed at the center of the lower plate, the motor comprising a screw axle;

a height sensor disposed on one of the plurality of side plates, wherein the height sensor generates height signals to actuate the motor;

a control circuit that is connected to the height sensor and the motor;

a motor-driven base comprising:

a positioning trench;

a plurality of holes through the bottom of the positioning trench at an equal distance apart from each other;

a screw hole in the middle of the positioning trench for the axle to extend therethrough;

a plurality of elastic objects, each one of the plurality of elastic objects corresponding to a single one of the plurality of holes;

a sense stick corresponding to each one of the plurality of elastic objects, wherein each one of the sense sticks protrudes through one of said corresponding holes; and wherein the axle of the motor drives the motor-driven base upward or downward in response to height signals received by the control circuit.

2. The health bed of claim 1 wherein, the control circuit stores information of height of the plurality of elastic objects; and the control circuit actuates the motor to adjust height of each of the plurality of elastic objects in accordance with the information of height of each of the plurality of elastic objects.

* * * * *